US006467860B2

(12) United States Patent
Remmers

(10) Patent No.: US 6,467,860 B2
(45) Date of Patent: Oct. 22, 2002

(54) DRAWER GLIDE SYSTEM

(75) Inventor: Lee Remmers, Ocala, FL (US)

(73) Assignee: Clairson Corporation/Emerson Electric Company, Ocala, FL (US)

( * ) Notice: Subject to any disclaimer, the term of this patent is extended or adjusted under 35 U.S.C. 154(b) by 0 days.

(21) Appl. No.: 09/804,216

(22) Filed: Mar. 12, 2001

(65) Prior Publication Data

US 2002/0125802 A1 Sep. 12, 2002

(51) Int. Cl.[7] ..... A47B 88/00

(52) U.S. Cl. ..... 312/334.7; 312/334.16; 312/334.23

(58) Field of Search ..... 312/330.1, 334.1, 312/334.16, 334.23, 311; 384/20, 23

(56) References Cited

U.S. PATENT DOCUMENTS

| | | | | |
|---|---|---|---|---|
| 2,606,091 | A | * | 8/1952 | Buchy et al. |
| 2,822,232 | A | * | 2/1958 | Lhota |
| 3,003,841 | A | * | 10/1961 | Branche et al. |
| 3,099,501 | A | | 7/1963 | Hillson et al. |
| 3,519,319 | A | * | 7/1970 | Taylor |
| 4,070,076 | A | | 1/1978 | Zwillinger |
| 4,114,945 | A | * | 9/1978 | Lutz |
| 4,121,878 | A | | 10/1978 | Lokken |
| 5,810,179 | A | | 9/1979 | Kleiman |
| 4,549,771 | A | | 10/1985 | Crosaonneau |
| 4,795,041 | A | | 1/1989 | Remmers |
| 5,086,936 | A | | 2/1992 | Remmers |
| 5,222,612 | A | | 6/1993 | Binder |
| 5,230,554 | A | | 7/1993 | Camilleri |
| 5,243,736 | A | | 9/1993 | Cannaday et al. |
| 5,330,063 | A | | 7/1994 | Remmers |
| 5,407,084 | A | | 4/1995 | Remmers |
| 5,421,647 | A | | 6/1995 | Simons |
| 5,472,270 | A | | 12/1995 | Czarnecky et al. |
| 5,486,046 | A | | 1/1996 | Jernstrom et al. |
| 5,490,724 | A | | 2/1996 | Domenig |
| 5,607,213 | A | | 3/1997 | Slivon et al. |
| 5,927,838 | A | | 7/1999 | Hellman, Jr. |
| 5,984,442 | A | | 11/1999 | Hellman, Jr. |

* cited by examiner

*Primary Examiner*—Janet M. Wilkens

(57) ABSTRACT

A sliding drawer system, containing two opposite facing slide members, two drawer glides, and a sliding drawer or wire basket. Each slide member contains a longitudinal interior channel running substantially the length of the slide member. The drawer contains an outer rim that engages and slides across a dome located at a front end of each slide member. The two drawer glides are attached to the drawer along the along the drawer's outer rim for slidable engagement with the longitudinal interior channel of the slide members. The apparatus contains features designed to reduce friction between the sliding parts so as to ease the inward and outward sliding of the drawer and to increase its effective life.

9 Claims, 8 Drawing Sheets

DRAWER GLIDE SYSTEM

BACKGROUND OF THE INVENTION

Conventional cabinet and closet drawer organizers have relatively long carriers for containers, such as drawers or wire baskets to hold objects for storage. Items placed at the back of the organizer drawers are often difficult to reach, and sometimes items within the drawer must be removed to reach a particular item, or a drawer must be removed in order to remove the item. Shelving manufacturers have attempted to solve the problem by installing complicated rail and roller systems to support and guide a container within a support frame so that an upper drawer may be slidably moved to expose the contents of the lower drawer. Existing systems usually consist of track elements integrally formed within the sides of the drawers. These conventional systems are designed for a particular drawer or frame, non-interchangeable, and usually consist of several moving parts that can wear out, causing the movable support system to not work properly. Replacement of a track system, or installation of a track system within a drawer having no track system requires precise measurement and location of the track components.

Shelving and drawer manufacturers have continued to develop improved systems to replace the burdensome track systems described above, the goal being to provide easier and more reliable access for the user to hard to reach storage areas. Many improvements have been made involving the use of rollers, but apparatuses having moving mechanical parts (such as rollers) are more susceptible to failure than those without rollers. Other improvements have involved sliding systems without rollers. For instance, U.S. Pat. No. 5,222,612 discloses a shelf for a cabinet having guides, the shelf having parallel bars for sliding between two guides of the cabinet. U.S. Pat. No. 5,330,063 is directed toward a glide system for a basket, the glide system having an interior channel for slidable engagement with a slide means attached to the base of the basket. U.S. Pat. No. 5,407,084 is directed to a glide runner support system wherein two longitudinal members having a channel therein supporting a sliding basket. U.S. Pat. No. 5,230,554 is generally directed toward a sliding storage basket having an interlocking sliding support means for use on the base of a basket.

A problem with the newer systems is that as the drawers or wire baskets get increasingly heavier, the design of the prior art tracks and roller systems become harder to operate due to increased friction and sticking between the sliding parts. This hinders access to the contents of the drawers, as the drawers can have a tendency to stick, and sometimes not open at all. The sliding drawer system of the present invention provides a means for reciprocal movement of containers or other such organizers with minimum friction between the sliding parts. This allows for easier and longer lasting access to the contents of the containers, as the effect of friction on the sliding parts is minimized.

SUMMARY OF THE INVENTION

The object of the present invention is a novel sliding drawer system. This system comprises two opposite-facing slide members, the slide members being substantially mirror images of each other. The slide members are usually attached to opposite facing walls, such as in a cabinet. Each slide member contains a longitudinal interior channel with a slide rib running substantially the entire length of the channel. One end of each slide member, the front or first end, is attachable to its respective support structure. Each slide member is also attachable to its respective support structure at a point located within the longitudinal interior channel of each slide member.

The novel sliding drawer system also contains a drawer, preferably a wire basket. The drawer contains an outer rim that, when in use with the two slide members, can slide across a dome located on the first end of each slide member. Furthermore, two novel drawer glides are attached to the drawer along the along the drawer's outer rim. The drawer glides can be 'C'-shaped, with a beveled upper portion, a beveled lower portion, a side wall and an inner portion to receive the outer rim of a drawer. The position of the drawer glides is on opposite sides of the drawer, such that one drawer glide travels within the longitudinal interior channel of its corresponding slide member. Thus, when the drawer is pulled out and pushed in, preferably the only sliding contact the drawer itself has with the slide members is between the drawer's rim and the two domes located on the first end of each slide member. The drawer glides travel between a rear stop face located at a second end of each slide member, and a front stop face located at the first end of each slide member. By minimizing the contact between the drawer rim and the slide member, friction between the two is reduced, allowing for easier sliding of the drawer.

DESCRIPTION OF ILLUSTRATIVE EMBODIMENTS

The present invention is directed to a novel sliding drawer system comprising two opposite facing novel slide members, a drawer with an outer rim, and two novel drawer glides. The apparatus works such that the drawer, with the assistance of the drawer glides, slides inwardly and outwardly on the slide members with a minimal frictional effect, increasing both the effectiveness and the life of the assembly.

A primary object of the present invention is to provide a drawer or, preferably, a wire basket for the storage of a person's belongings. The drawer has an outer rim, which in one embodiment is located along the upper portion of the drawer. The drawer, including the rim, can be made out of wood, plastic, metal, composite material, or any combination thereof, but preferably is composed primarily of plastic-coated metal rods.

Figure 1:
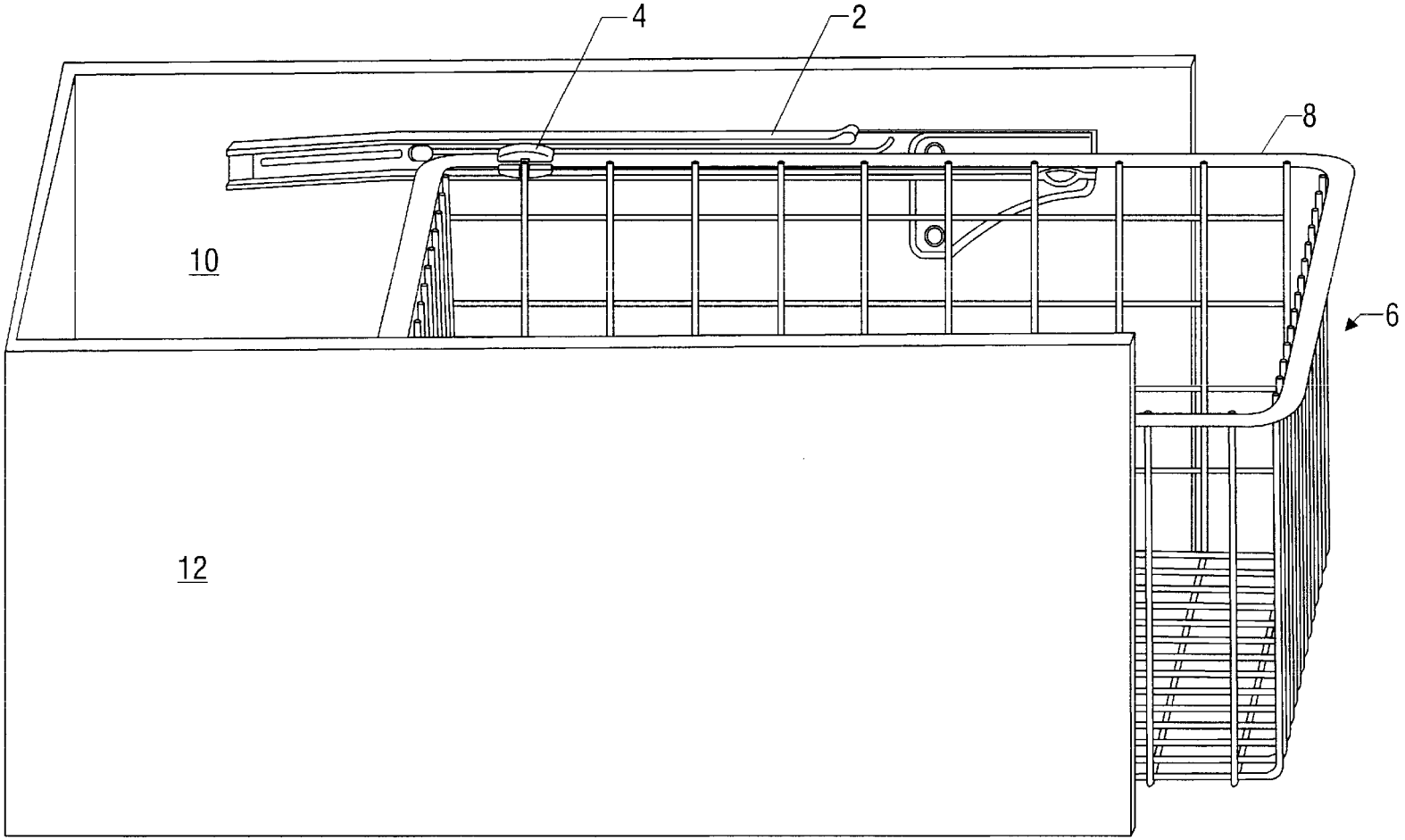
FIG. 1 shows a perspective view of a preferred embodiment of the present invention.

Referring now to the drawings, FIG. 1 shows a preferred embodiment of the present invention, a sliding drawer system using a wire basket. A slide member 2 is mounted to a first support structure 10. Mounted in a preferably horizontal, parallel relationship to the slide member 2 is a second slide member (not shown) mounted to second support structure 12. The support structures 10 and 12 shown in FIG. 1 can be two opposite facing walls of a basic drawer design, but the sliding drawer system of the present invention is not limited by the type of support structure used. A wire basket 6 is provided having an outer rim 8. A first drawer glide 4 is attached to the outer rim 8 in the most preferred position at the rear of the wire basket 6. A second drawer glide (not shown) is attached to the wire basket 6 in a similar position on the opposite side of the wire basket 6. The two drawer glides slide within an interior channel of the slide member 2.

Figure 2:
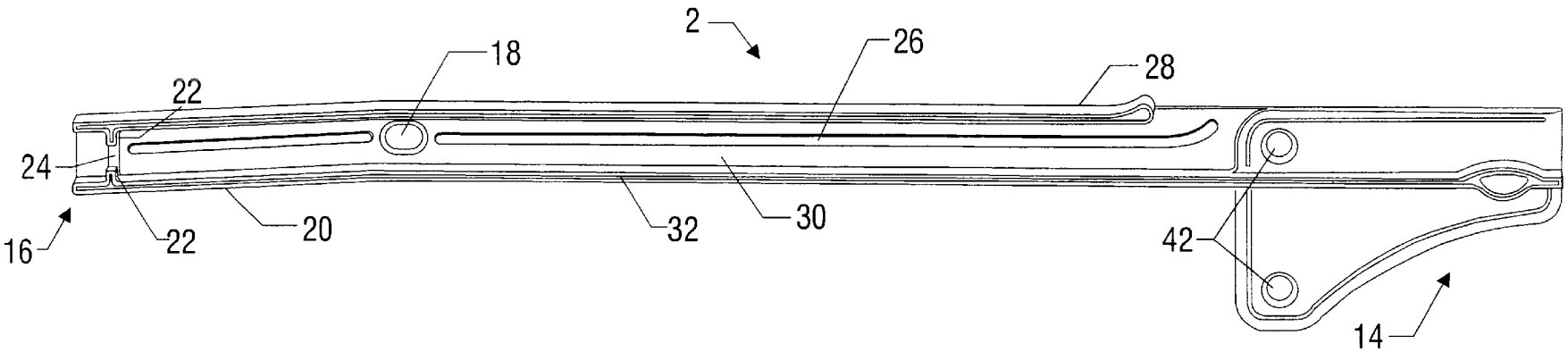
FIG. 2 shows an embodiment of the slide member of the present invention.

FIG. 2 sets forth a view of the novel slide member 2 of the present invention. Each slide member 2 has two ends, a first end 14, shown in greater detail in FIG. 3, and a second end 16. FIG. 2 shows that between the first end 14 and the second end 16 is the longitudinal interior channel of the slide member 2 defined by a top wall 28, a side wall 30 and a bottom wall 32. In a preferred embodiment, a slide rib 26 is connected to the side wall 30 and runs substantially the length of the longitudinal interior channel. The function of this slide rib is to minimize the contact between the side wall and the drawer glide, reducing friction between the two. A preferred way for attaching the slide member 2 to a support structure at the first end is a hole 42 capable of receiving a screw, nail, or like device, is shown in more detail in FIGS. 3 and 4.

FIG. 2 also illustrates the preferred embodiment of the second end 16 of the slide member 2, which contains a rear stop face 22 to prevent a drawer glide from further rearward movement as the drawer is pushed inwardly. The stop face 22 preferably extends from the side wall 30 of the longitudinal interior channel into the channel itself, blocking the sliding motion of the drawer glide. In a preferred embodiment, a slot 24 is provided in the stop face 22, the slot 24 being wide enough so that a drawer rim can pass through the stop face, but narrow enough that it will prevent the drawer glide from sliding through. The interaction between the second end 16, the drawer glide and the drawer rim is shown in more detail in FIG. 8.

FIG. 2 also shows an embodiment of the present invention, in which a portion 20 of the longitudinal interior channel near the second end 16 is slanted downwardly from the main channel to the second end 16 of the slide member 2. This downward slanting portion 20 provides a self-closing feature, allowing gravity to keep the drawer in a closed position. The slide member's second attachment to a support structure is also shown in FIG. 2 in its preferred embodiment as an oblong hole 18 located within the longitudinal interior channel. This oblong hole 18 is preferably located within the longitudinal interior channel, preferably near the second end 16, and most preferably at the point on the longitudinal interior channel immediately before the portion 20 of the channel that slopes downwardly to the second end 16, or at the second end itself. The preferred embodiment is an oblong hole that allows for any misalignment that may occur during installation of the sliding drawer system of the present invention.

Figure 3:
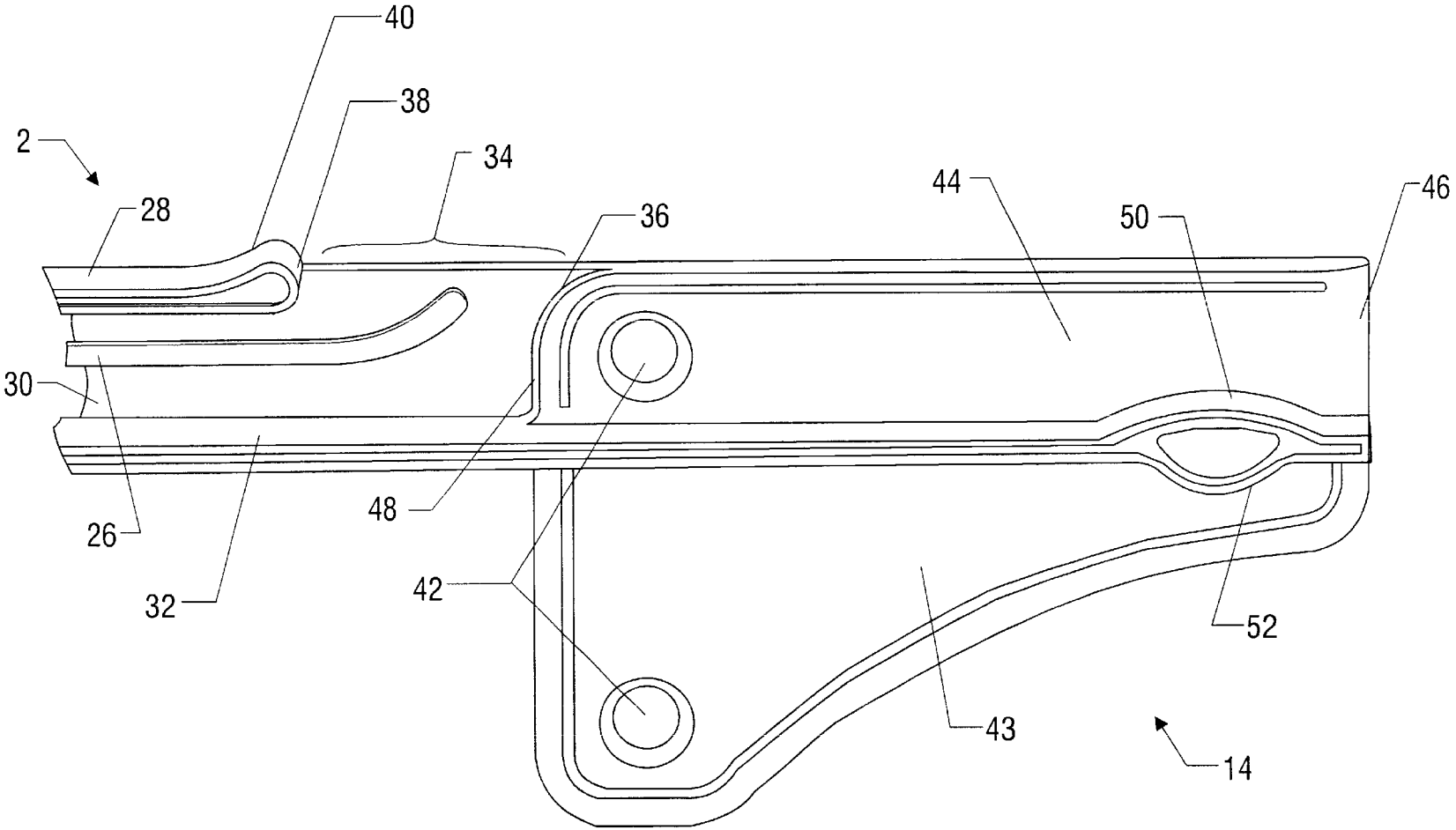
FIG. 3 details a first end of an embodiment of the slide member of the present invention.

Looking now at FIG. 3, the first end 14 of the slide member 2 is shown in greater detail. In one embodiment of the present invention, the top wall 28 has a drawer glide opening 34 for insertion of a drawer glide into the longitudinal interior channel. The opening 34 is defined by a preferably beveled face 38 on the top wall 28 of the longitudinal interior channel and a preferably beveled face 36 on the first end 14 of the slide member. The top wall 28 near opening 34 preferably has a reinforcing bevel 40 behind it so as to give the opening 34 more support when a drawer glide is being placed into the longitudinal interior channel. As shown, the slide rib 26 that runs the length of the longitudinal interior channel preferably ends near the first end 14.

The slide member is attachable to a support structure at the first end 14 of the preferred embodiment using two mounting holes that can accept a fastener device (not shown), preferably a screw, to connect the first end 14 to a support structure. The mounting holes 42 can located within a reinforcing brace 43 and/or a protrusion guide 44 located at the first end 14 of the slide member 2. The reinforcing brace 43 is shown in FIG. 3 as extending below the bottom wall 32 of the longitudinal channel that has extended onto the first end 14. The reinforcing brace 43 may be substantially triangular shaped, providing the extra support to the first end 14 of the slide member 2, or any other shape such that extra support is provided. The protrusion guide 44 may be located above the bottom wall 32 of the longitudinal interior channel, and functions such that when the rim of the basket passes by the protrusion guide, side to side movement of the basket is limited.

The front edge 46 of the protrusion guide 44 is also shown in FIG. 3. In a preferred embodiment, the front edge 46 is beveled to further reduce friction between the slide member and the drawer rim as the drawer slides inwardly and outwardly. The rear edge of the protrusion guide 44 can also act as the front stop face 48 for preventing further forward movement of the drawer glide, once it reaches that position. In one such embodiment, the front stop face 48 extends from the side wall 30 of the interior channel into the channel so that when a drawer is fully pulled out, a drawer glide, preferably located at the rear of the drawer, contacts the stop face 48, ceasing its forward movement. The interaction between the stop face 48 and a drawer glide that prevents the drawer from being pulled out all the way is shown in more detail in FIG. 7.

The first end 14 of the slide member 2 also preferably contains a dome 50 upon which the drawer rim can rest on the drawer is not in motion, and for the drawer rim to slide over as the drawer is pulled out and pushed in. In a preferred embodiment, the dome 50 is located on the bottom wall 32 of the longitudinal channel that extends onto the reinforcing brace/protrusion guide portion of the first end 14, near the front edge 46 of the protrusion guide 44. The dome 50 reduces the sliding friction between the drawer and the slide member because as a drawer slides inwardly and outwardly, the drawer rim preferably contacts the slide member only at the peak of the dome, limiting contact between the drawer and the slide member, and thus reducing sliding friction. Directly underneath the dome 50 may be a reinforcing dome 52 that provides extra support to the front of the slide member and to the bottom of the dome 50. The interaction between the dome 50 and a drawer rim is shown in more detail in FIG. 6.

Figure 4:
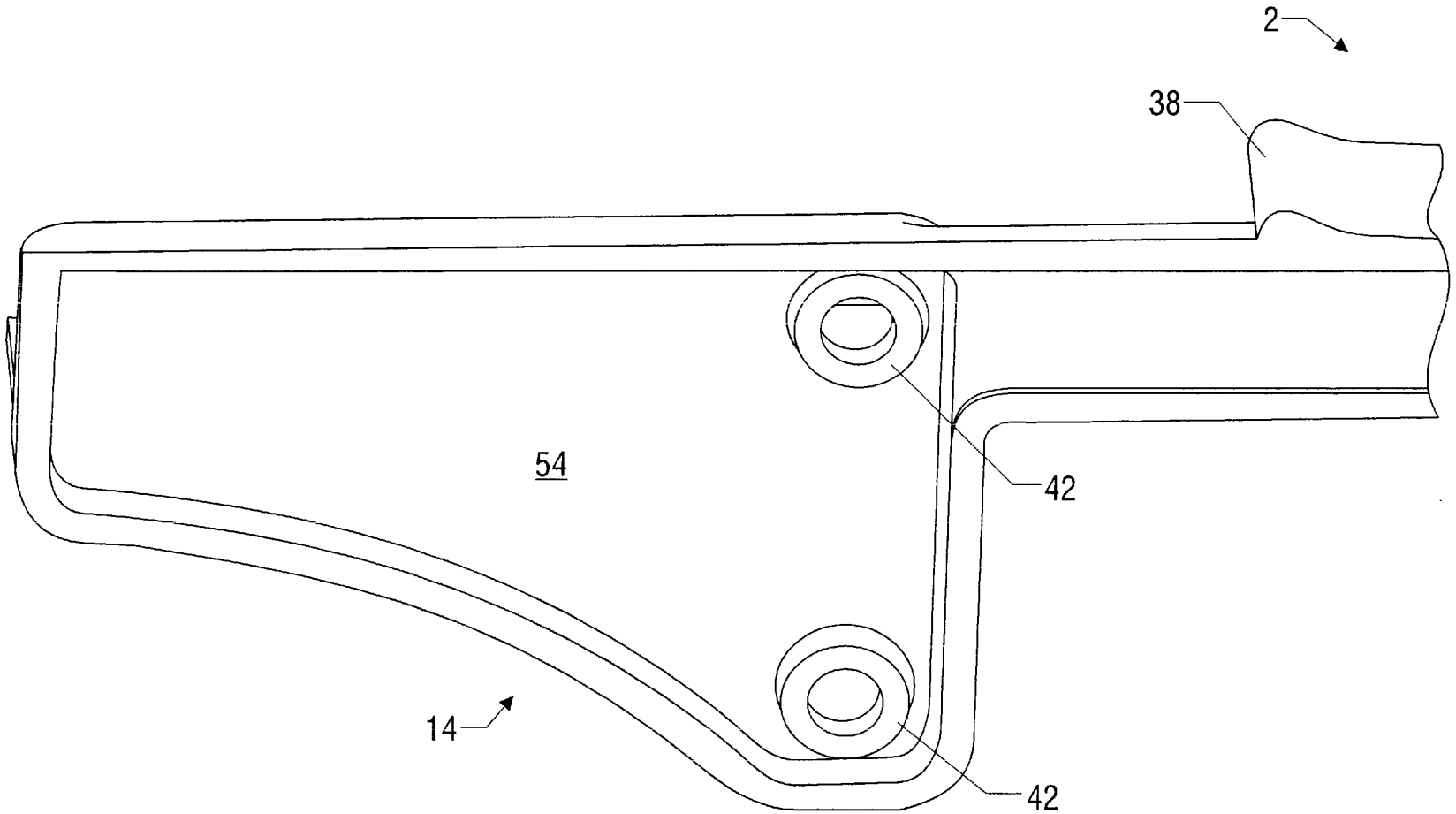
FIG. 4 shows the reverse side of a first end of an embodiment of the slide member of the present invention.

FIG. 4 shows the reverse side of the first end 14 of the slide member 2. This side of the first end 14 is preferably hollowed out, as shown 54, so that the drawer glide 2 can better fit against any mounting surface.

Figure 5:
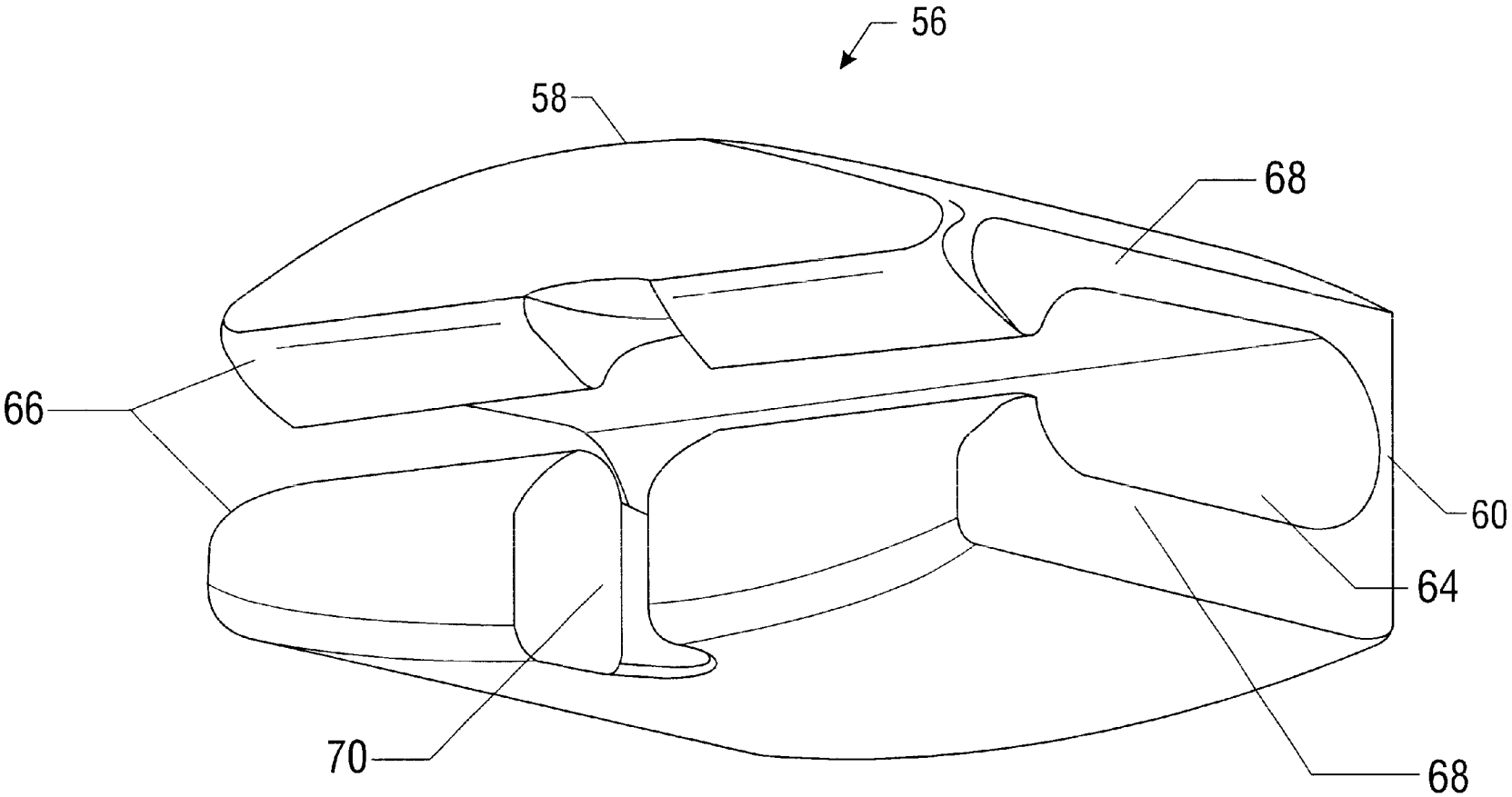
FIG. 5 is a front perspective view of an embodiment of a drawer glide of the present invention.

The drawer glide of the present invention, shown in FIG. 5, attaches to the outer rim of the drawer, preferably at the rear of the drawer. The drawer glide 56 can be shaped in any manner so that it provides improved sliding of the drawer or basket inwardly and outwardly along a longitudinal interior channel of a slide member of the present invention. The drawer guide is preferably made out of plastic, but may be made out of any material that allows sliding between the drawer guide and a slide member.

In a preferred embodiment the drawer glide 56 has a 'C'-shaped body (from a side view) defined by an upwardly beveled top wall 58, a side wall 60, and a downwardly beveled bottom wall 62, defining a channel 64 within the drawer glide for insertion of and attachment to the outer rim of the drawer. The beveled walls of the drawer glide reduce the contact between the drawer glide and the slide member, thus reducing the friction between the two, allowing for an easier sliding motion of the drawer.

The preferred embodiment of the drawer glide shown in FIG. 5 also illustrates the two curved front edges 66 of the top wall 58 and the bottom wall 62 for ease of installation of the drawer glide onto the outer rim of the drawer. The side edges 68 of the drawer glide 56, defined by the edges of the combination of the top wall 58, the side wall 60, and the bottom wall 62 of the drawer glide 56 (the edges that give the glide its 'C'-shaped appearance) may be slanted toward the center of the drawer glide. These outer edges 68, when slanted, apply additional pressure to the outer rim of the drawer for a constant, tight fit of the drawer glide to the rim of the drawer. Thus, when the drawer glide is attached to the outer rim of the drawer, the drawer glide stays in substantially the same position relative to the drawer. When used with a wire basket, the bottom wall 62 of the drawer glide 56 can further comprise a wire notch 70 such that a vertical wire on the wire basket can pass into the wire notch. The interaction of the drawer glide 56 with a wire basket is shown in FIG. 8.

Figure 6:
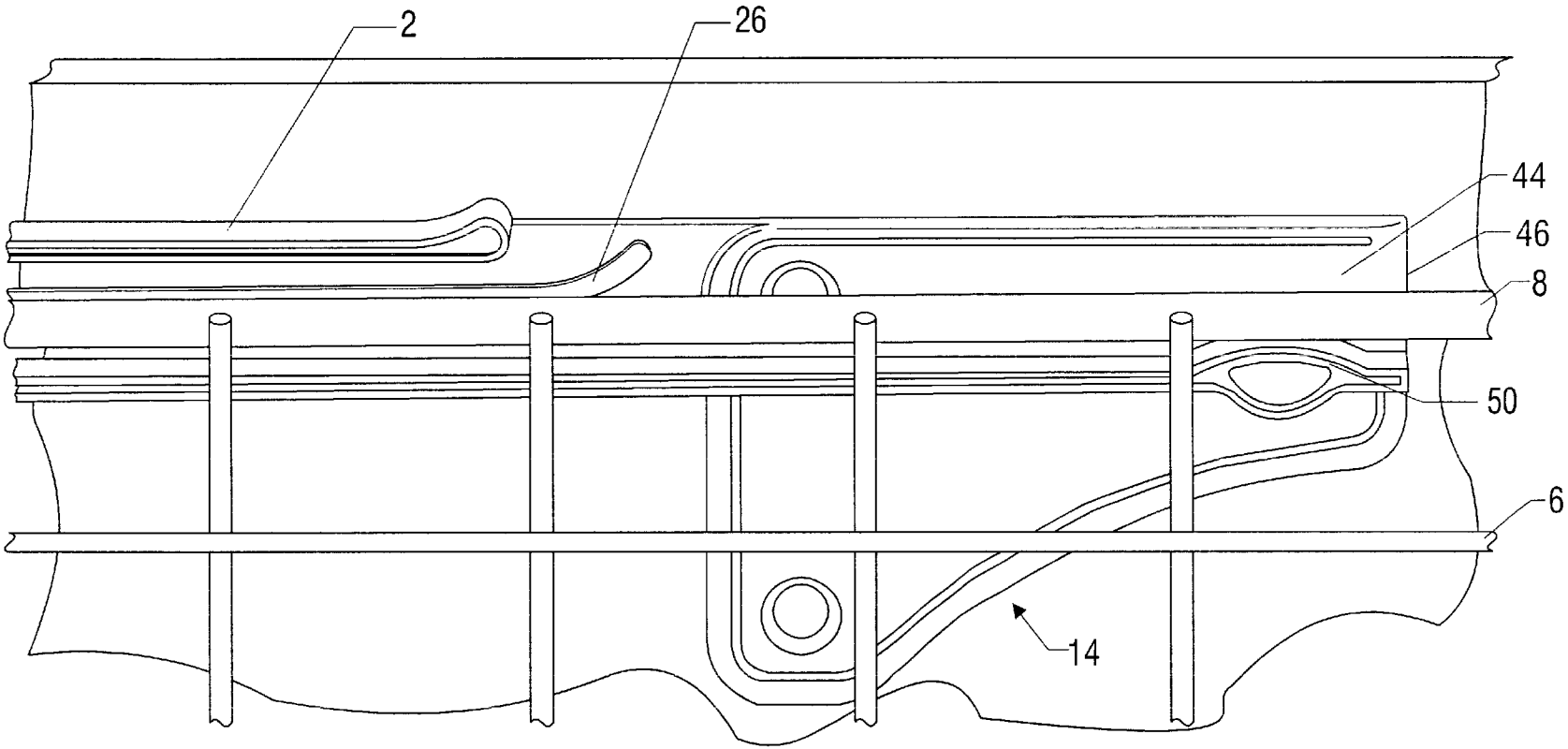
FIG. 6 is a front view of a drawer glide system illustrating the interaction of an outer rim of a wire basket with a first end of an embodiment of the slide member of the present invention.

FIG. 6 illustrates the interaction between the outer rim 8 of a wire basket 6 with the first end 14 of the slide member 2. Preferably, the only sliding contact the outer rim 8 has with the slide member 2, is with the dome 50. The protrusion guide 44 limits the side to side motion of the wire basket 6. The front edge 46 of the first end 14 is preferably beveled, providing a smooth, rounded entry for the drawer rim 8 as the drawer or wire basket 6 slides inwardly and outwardly in the slide member 2, further reducing sliding friction.

Figure 7:
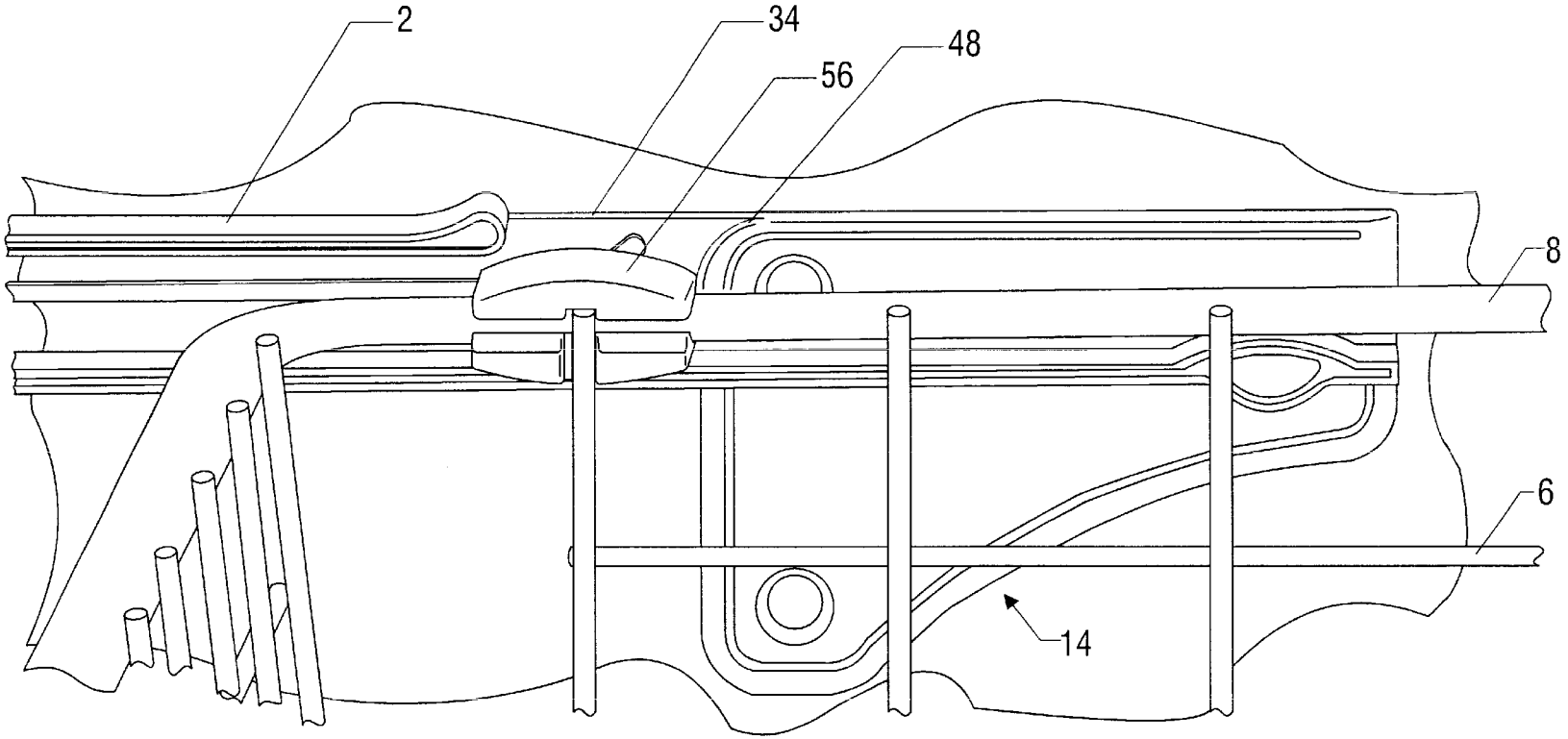
FIG. 7 is a front view of a drawer glide system illustrating the interaction of an embodiment of the drawer glide of the present invention with a first end of an embodiment of the slide member of the present invention.

FIG. 7 shows the wire basket 6 pulled as far out as the front stop face 48 of the first end 14 will allow. The drawer glide 56 contacts the front stop face 48, preventing further outward motion of the drawer or wire basket 6. The drawer rim 8 continues to rest solely on the dome 50 of the first end 14. If a person wished to remove the wire basket 6 from the slide member 2, that person would lift the drawer glide 56 through the drawer glide opening 34 and remove the wire basket 6.

Figure 8:
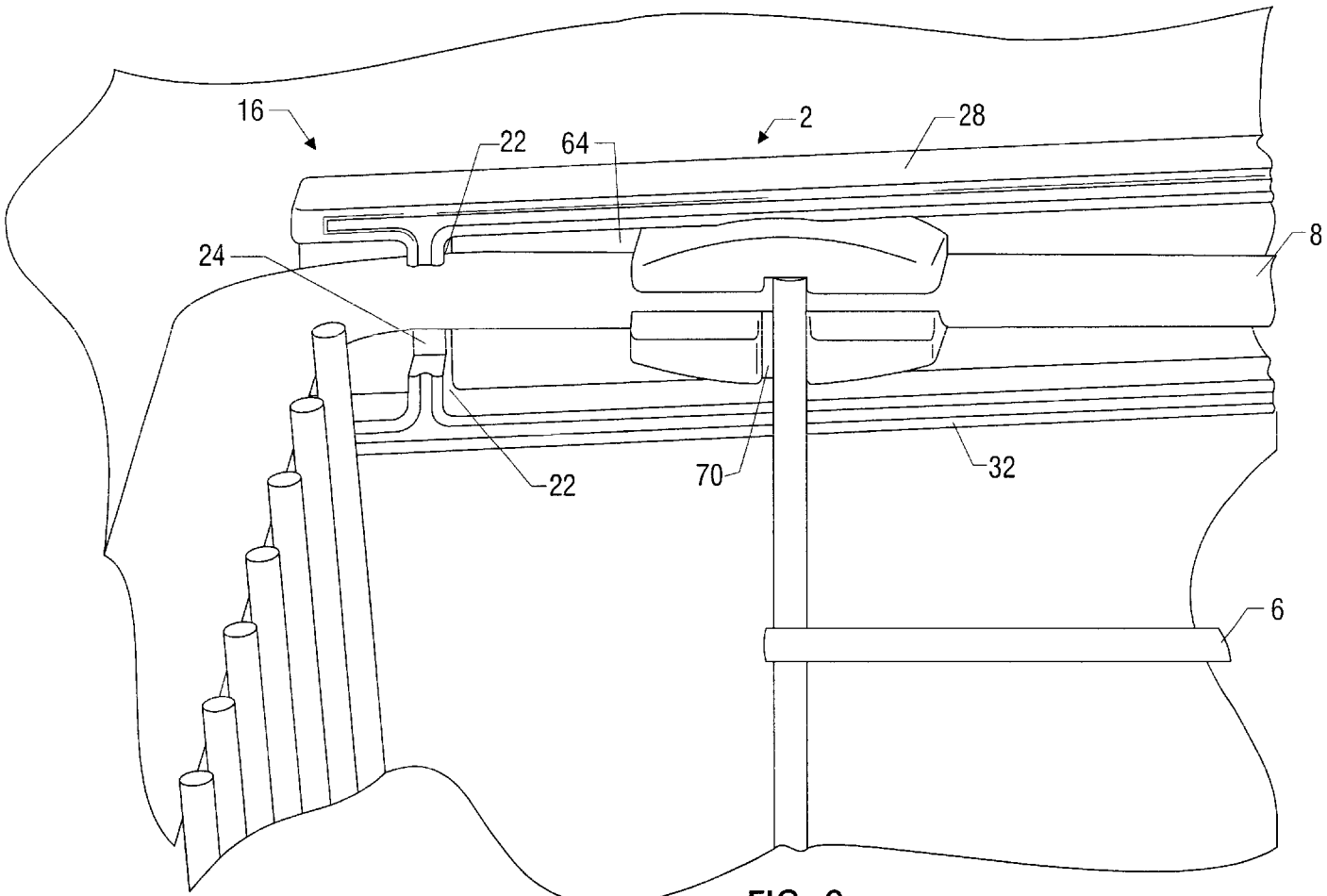
FIG. 8 is a front view of a drawer glide system illustrating the interaction of a drawer glide located on the outer rim of a wire basket with a second end of an embodiment of the slide member of the present invention.

Finally, FIG. 8 shows the wire basket 6 pushed almost as far back as it will go in the slide member 2. The notch 24 of the rear stop face 22 at the second end 16 of the slide member 2 allows for the drawer rim 8 to pass through the rear stop face 22 until the drawer glide 56 contacts the rear stop face 22, restricting further backward movement of the drawer. FIG. 8 also illustrates a preferred way in which the drawer glide 56 is attached to a wire basket 6. The channel 64 within the drawer glide 56 attaches to the outer rim 8 of the wire basket, while the wire notch 70 engages a vertical wire of the wire basket 6. The interaction of the drawer glide 56 with the longitudinal interior channel of the slide member 2 is also shown, with contact between the top wall of the drawer glide 56 with the top wall 28 of the longitudinal interior channel; the bottom wall of the drawer glide 56 with the bottom wall 32 of the longitudinal interior channel; and the side wall (not shown) of the drawer glide 56 with the slide rib (not shown).

FIGS. 6, 7 and 8 each show various perspectives of the interaction between the drawer, or the preferred embodiment wire basket, and the slide member. It should be understood that similar interactions are taking place on the other side of the drawer, as two slide members are used to support the opposite sides of the drawer.

While the structures of the present invention have been described in terms of preferred embodiments, it will be apparent to those of skill in the art that variations may be applied to the what has been described herein without departing from the concept and scope of the invention. All such similar substitutes and modifications apparent to those skilled in the art are deemed to be within the scope and concept of the invention as it is set out in the following claims.

What is claimed is:

1. A sliding drawer system comprising a wire basket having an outer rim with first and second sides;

first and second drawer glides attached to the first and second sides of the outer rim of the wire basket, respectively, and first and second slide members, each slide member comprising a longitudinal interior channel defined by a top wall, a bottom wall, and a side wall; a drawer glide opening; a first end comprising a front stop face and a dome; a second end comprising a rear stop face; the slide member being attachable to a support structure; wherein the first and second slide members are in a horizontally parallel relationship such that the longitudinal interior channel of first slide member and said longitudinal interior channel of the second slide member face each other, and wherein a rear portion of the longitudinal interior channels for both the first and the second slide members is slanted downwardly;

the longitudinal interior channels of the first and second slide members slidably receiving the first and second drawer glides, respectively, such that the outer rim of the wire basket rests on the domes and is slidable thereon.

2. A sliding drawer system comprising a) a first and a second slide member, each slide member comprising a longitudinal interior channel defined by a top wall, a bottom wall, and a side wall; a drawer glide opening; a first end comprising a first dome; a second end comprising a rear stop face; the slide member being attachable to a support structure;

b) a first and a second drawer glide; and c) a drawer;

wherein the first and second drawer glides are attached to the drawer in such a manner that the first drawer glide can be placed into the longitudinal interior channel of the first slide member and the second drawer glide can be placed into the longitudinal interior channel of the second slide member thereby allowing the drawer glides to slide within said slide members.

3. The sliding drawer system of claim 2 wherein the first and second slide members each further comprise a slide rib positioned within their respective longitudinal interior channels along the side wall.

4. The sliding drawer system of claim 2 wherein a rear portion of the longitudinal interior channels for both the first and the second slide members is slanted downwardly.

5. The sliding drawer system of claim 2 wherein the rear stop face of both the first and second slide members is notched so that a rim of the drawer can pass through each rear stop face.

6. The sliding drawer system of claim 2 wherein the drawer is a wire basket.

7. The sliding drawer system of claim 6 wherein the first and the second drawer glides further comprise bottom walls, each comprising a notch so that a vertical wire on the wire basket can insert into the wire notch.

8. A slide member for a sliding drawer system comprising a longitudinal interior channel adapted to slidably receive a drawer glide, defined by a top wall, a bottom wall, and a side wall; a drawer glide opening; a first end comprising a first dome; a second end comprising a rear stop face that is notched so that a rim of a sliding drawer can pass through the rear stop face; the slide member being attachable to a support structure.

9. A glide comprising a body defined by an upwardly beveled top wall, a side wall, and a downwardly beveled bottom wall, said walls defining an opening to receive a rim of a sliding drawer, the bottom wall further comprising a notch so that when the glide is attached to a wire baskets a vertical wire on the wire basket can insert into the notch.

* * * * *

UNITED STATES PATENT AND TRADEMARK OFFICE

CERTIFICATE OF CORRECTION

PATENT NO. : 6,467,860 B2
DATED : October 22, 2002
INVENTOR(S) : Lee Remmers

It is certified that error appears in the above-identified patent and that said Letters Patent is hereby corrected as shown below:

Title page,
Item [57], ABSTRACT,
Line 8, please delete the first appearing "along the"

Column 8,
Line 11, please delete "baskets" and insert -- basket --.

Signed and Sealed this

Eighteenth Day of February, 2003

JAMES E. ROGAN
*Director of the United States Patent and Trademark Office*